US005508915A

United States Patent [19]

Tsao et al.

[11] Patent Number: 5,508,915

[45] Date of Patent: Apr. 16, 1996

[54] METHOD TO COMBINE STATISTICAL AND ENGINEERING TECHNIQUES FOR STUCK PIPE DATA ANALYSIS

[75] Inventors: Yuh-Hwang Tsao; William E. Kline, both of Houston; Michele M. Thomas, Midland; Eugene A. Sikirica, Katy; Albert T. Wang, Houston; Marco Rasi, Houston, all of Tex.

[73] Assignee: Exxon Production Research Company, Houston, Tex.

[21] Appl. No.: 492,860

[22] Filed: Jun. 20, 1995

Related U.S. Application Data

[63] Continuation of Ser. No. 110,157, Aug. 20, 1993, abandoned, which is a continuation of Ser. No. 580,665, Sep. 11, 1990, abandoned.

[51] Int. Cl.[6] ..... G06F 19/00; E21B 44/00

[52] U.S. Cl. ..... 364/422; 73/151

[58] Field of Search ..... 364/421, 422, 364/554; 73/151; 175/61, 65, 24, 27

[56] References Cited

U.S. PATENT DOCUMENTS 4,685,329 8/1987 Burgess ..... 73/151
4,773,263 7/1988 Lesage et al. ..... 73/151
4,791,998 12/1988 Hempkins et al. ..... 175/61

*Primary Examiner*—Donald E. McElheny, Jr.
*Attorney, Agent, or Firm*—Gary D. Lawson

[57] ABSTRACT

The current invention is a method for modeling the probability of a drill string becoming stuck within a given time frame and a method for applying the model to a well being drilled to reduce the probability of sticking. The model is constructed by performing canonical discriminant analysis on engineering parameters derived from observations taken in historical wells and creating a canonical space with the resulting canonical functions. Posterior probabilities of sticking are then calculated from the historical observations and mapped into the canonical space. To apply the model to a particular well being drilled, the values of the previously derived engineering parameters are calculated from observations in the well being drilled, multiplied by their corresponding canonical coefficients, and summed to obtain a canonical point representation for drilling in that well. This canonical point representation is then mapped into the canonical space to obtain the probability of sticking. The probability of sticking is then compared to probabilities experienced in the past under similar drilling conditions. If the probability of sticking in the well being drilled is found to be higher than average historical probability, it can be reduced by implementing remedial measures that are suggested by simple inspection of the values of the engineering parameters.

6 Claims, 4 Drawing Sheets

METHOD TO COMBINE STATISTICAL AND ENGINEERING TECHNIQUES FOR STUCK PIPE DATA ANALYSIS

This application is a continuation, of application Ser. No. 08/110,157, filed on Aug. 20, 1993, abandoned, which is a continuation of application Ser. No. 07/580,665, filed on Sep. 11, 1990, abandoned.

BACKGROUND OF THE INVENTION

1. Field of the Invention

This invention pertains to the analysis of well data for the purpose of predicting the probability of a drill string becoming stuck. More particularly, the invention pertains to a method of modeling the probability of a drill string becoming stuck in a well under given drilling conditions as determined from observations in previously drilled wells and of applying that model to determine the probability of sticking in a well being drilled.

2. Description of the Prior Art

It is well known to those in the art of oil well drilling that it is not unusual for a drill string to become stuck in the well bore and that this sticking can result from a wide variety of causes. Typically, these causes are grouped into those that cause mechanical sticking and those that cause differential sticking. Mechanical sticking, for instance, can be caused by key seating, undergauge hole, well bore instability, poor hole cleaning, drill string washout, junk in the hole, casing collapse, or excessive drag. Stuck pipe occurrences are widely held to be the most expensive drilling problem confronting the petroleum industry and the cost of correcting even a single occurrence can amount to millions of dollars. Most of the prior art regarding stuck pipe has been directed toward tile development of drilling techniques to minimize the risk of stuck pipe and to free stuck pipe once it has occurred. Statistics and statistical analysis have been used to improve the probability of freeing stuck pipe once sticking has occurred. The article "Stickiness Factor: A New Way of Looking at Stuck Pipe" by T. E. Love, published in the Oct. 3, 1983 issue of *Oil & Gas Journal* is one example. Until recently, however, very little effort has been directed to using statistical techniques for predicting the likelihood of stuck pipe under given conditions.

The most significant prior art in this area is disclosed in U.S. Pat. No. 4,791,998 issued to Chevron Research Co. as assignee of the inventors. The method disclosed in the '998 patent centers on multi-variate statistical analysis of "well drilling variable quantities" obtained from a number of previously drilled wells. These well drilling variables, or field variables, are measured quantities taken from observations of drilling conditions over the history of previous wells. These previous, or historical, wells are divided into classes according to the end result of the drilling, i.e., those wherein the drill string became mechanically stuck, those wherein the drill string became differentially stuck, and those wherein the drill string did not become stuck. The statistical analysis is performed on all of the measured values of the field variables of all the historical wells.

The results of the analysis are plotted to construct a "stuck pipe probability map". The map is then divided into three areas representing high likelihoods of the drill string remaining unstuck, becoming mechanically stuck, or becoming differentially stuck. Values corresponding to the field variables from the historical wells are then taken from a well being drilled, analyzed, and plotted on the map. The likelihood of the drill string becoming stuck can then be monitored by examining the position of the representation of drilling in the current well relative to the areas of high probability on the map. As the representation moves closer to areas of neutral or high probability of sticking, steps may be taken to improve drilling conditions by altering the values of selected variables to reduce the likelihood of sticking.

As is true of most methods for accomplishing a given task, the method disclosed in the '998 patent has been shown to be capable of improvement. The method disclosed and claimed herein is better in the modeling of probability and in applying the model to modify drilling conditions than the '998 patent's method some of whose field variables are highly interdependent, which results in two undesirable consequences. First, application of the model to current drilling conditions results in recommended actions contradictory to basic physics and/or logical engineering judgment to an unacceptably high degree. For example, two variables that have a high negative correlation would tend to cancel out if used simultaneously. Second, the effect of individual parameters on overall drilling conditions is difficult to ascertain and thereby impedes determination of corrective measures.

The '998 patent's method does not provide a quantitative assessment of the probability of sticking and assumes equal prior probabilities for each of the three groups. The method merely quantifies the probability that its indication of which result is more likely, i.e., whether it is more likely that the drill string will remain unstuck, become mechanically stuck, or become differentially stuck, is correct. Independent research has indicated in the meantime that the prior probabilities of falling into one of the three groups is far from being equal.

The '998 patent's method also indicates the most likely result only at the time the measurements are taken and does not provide a specific lag time in which drilling engineers may take corrective measures. The aggregate of these characteristics renders the '998 patent's method suitable primarily for surveillance. Drilling engineers need a more versatile tool that provides a quantitative assessment of the likelihood of sticking within a given time frame that also provides an indication of what corrective action to take so that they may evaluate the need for such corrective action and have time to implement it.

It is therefore a feature of this invention that it provides a more accurate method of modeling the likelihood that a particular drill string will become stuck.

It is furthermore an object of this invention to provide a method of modeling the likelihood of sticking that will yield a quantitative assessment of the probability.

It is still a further feature of this invention to provide a method of modeling the likelihood of sticking to provide drilling engineers with a better indication of which drilling variables need to be changed and how they should be changed in order to prevent stuck pipe.

It is further a feature of this invention to provide a method for ascertaining the probability of becoming stuck that will provide drilling engineers with a sufficient time period in which to evaluate the need for and take corrective action.

It is still further a feature of this invention to provide a method for applying an improved model for the probability of sticking to drilling conditions in a well being drilled to ascertain the quantitative probability of sticking within a given time frame, to compare this probability to the probability experienced in the past under similar conditions, and to determine the leading factors contributing to any overly high probability.

SUMMARY OF THE INVENTION

The current invention is a method for modeling the probability of a drill string becoming stuck within a given time frame under given conditions and a method for applying the model to a drill string in a well being drilled to reduce the probability of sticking. Modeling the probability of sticking begins with the determination of a plurality of field parameters from observations in historical wells, some of which resulted in the pipe becoming stuck and others where the pipe remained unstuck, and ascertaining the values for each of those field parameters. The field parameters are then used to derive a plurality of engineering parameters that are substantially independent of each other, are statistically significant in discriminating mechanisms associated respectively with the drill string becoming stuck and remaining unstuck, and whose values are calculated from the values of the field parameters. Canonical discriminant analysis is then performed on the values of the engineering parameters to obtain a set of canonical coefficients that will produce high discrimination between groups of stuck and nonstuck observations. These canonical coefficients are used to construct a multi-dimensional canonical space. Posterior probabilities of a drill string becoming stuck corresponding to each point in the canonical space are then determined from all the observations taken in the historical wells and are mapped into the canonical space. In this way, it is possible to provide a map with isoprobability curves that will more accurately delineate the areas representing high likelihood of sticking while simultaneously providing a quantification of that likelihood.

The model is applied to a drill string in a well by ascertaining the values in the well being drilled for the engineering parameters previously derived. These values are then multiplied by their respective canonical coefficients and summed to form a canonical point representation of drilling conditions in the well. This canonical point representation is mapped into the previously constructed canonical space whereupon the quantified probability corresponding to that mapped location represents the probability of sticking within a given time frame.

BRIEF DESCRIPTION OF THE DRAWINGS

So that the manner in which the above-recited features, advantages and objects of the invention, as well as others which will become apparent, are attained and can be understood in detail, a more particular description of the invention briefly summarized above may be had by reference to the exemplary preferred embodiments illustrated in the drawings, which form a part of this specification. It is to be noted, however, that the appended drawings illustrate only typical preferred embodiments of the invention and are not to be considered limiting of its scope as the invention may admit to other equally effective embodiments.

In the drawings.

DESCRIPTION OF THE PREFERRED EMBODIMENT

The first step in modeling stuck and non-stuck probabilities is the determination of field parameters from both stuck and non-stuck observations in historical wells. Theoretically, the model only requires observations from two wells wherein the drill string became stuck and two wells wherein the drill string remained unstuck and that these wells be drilled in the same geological region. The preferred embodiment contemplates observations from over 1400 drilling days and in over a hundred different wells in the Gulf of Mexico because reliability and accuracy increase with increasing number of wells. These field parameters include two types of variables denoted as field drilling variables and default variables.

Figure 1:
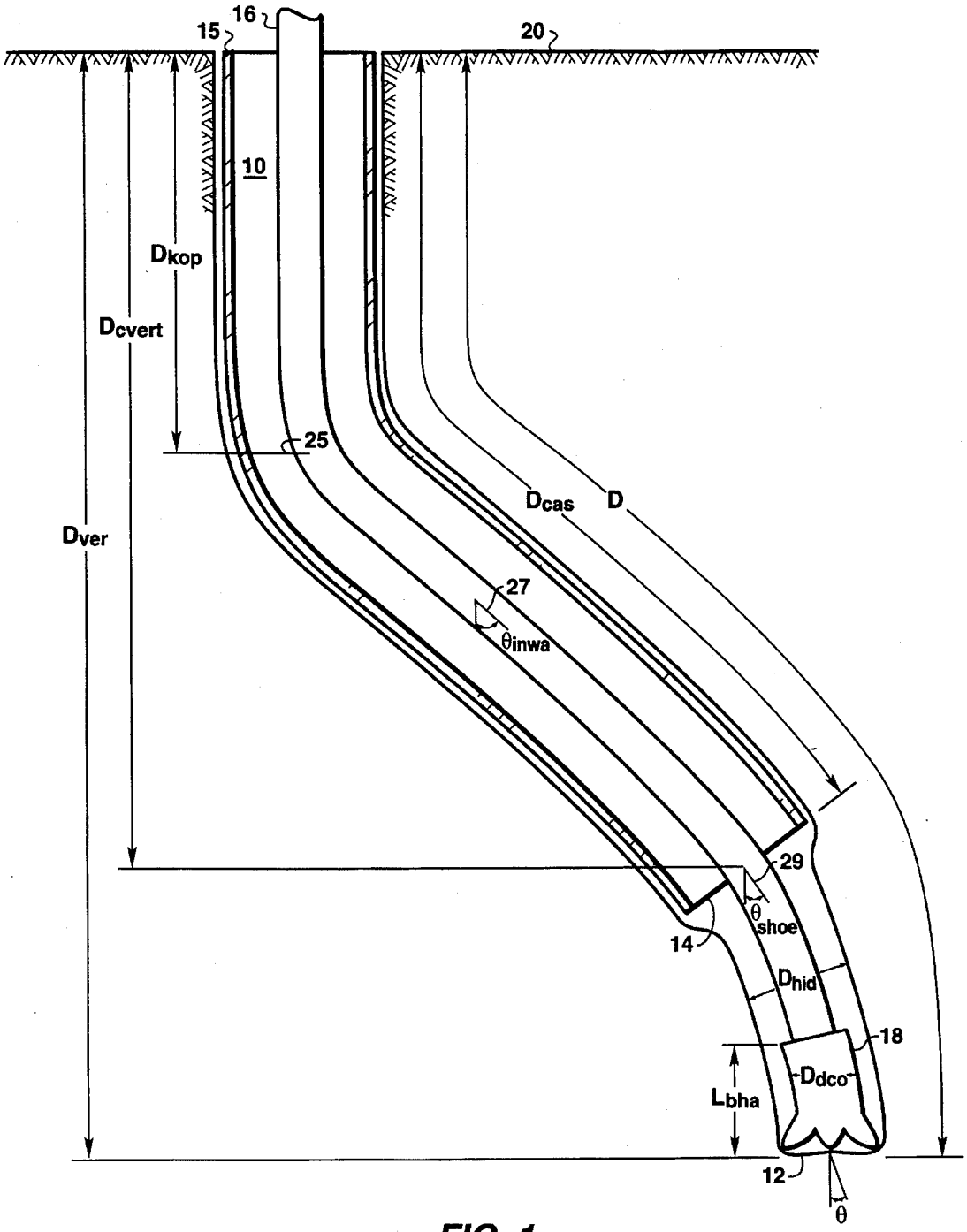
FIG. 1 illustrates the definition of selected parameters.

Field drilling variables are defined to be those quantities that are measured daily throughout the lifetime of the historical wells and correspond to what the '998 patent terms "well drilling variables". It is the normal practice of most oil well drillers to measure a predetermined set of quantities determinative of drilling conditions on a daily basis and to keep records of those observations both during and after drilling the well. The field drilling variables contemplated by the preferred embodiment are listed in Table 1 along with their identifying symbols and units of measurement. The identity of each variable and how to take its measure are well known to those ordinarily skilled in the art. Those variables given to illustration are depicted in FIG. 1 and are discussed further below.

TABLE 1

FIELD DRILLING VARIABLES

| PARAMETER | SYMBOL | UNITS |
|---|---|---|
| Measured Depth of the Well | $D$ | feet |
| Measured Depth of the Casing Shoe | $D_{cas}$ | feet |
| Maximum Well Angle | $\theta_{mwa}$ | degrees |
| Maximum Open Hole Angle | $\theta_{moh}$ | degrees |
| Current Drilling Angle | $\theta$ | degrees |
| Inner Diameter of Hole | $D_{hid}$ | inches |
| Outer Diameter of the Drill Collar | $D_{dco}$ | inches |
| Bottom-hole Assembly Length | $L_{bha}$ | feet |
| Number of Stabilizers | $N_{stab}$ | — |
| Pick-up Weight | $W_{pu}$ | kilo-pounds |
| Slack-off Weight | $W_{so}$ | kilo-pounds |
| Mud Weight | $W_{mud}$ | ppg |
| API Fluid Loss | $V_{api}$ | milliliters |
| Chloride | $C$ | Kilo-ppm |
| Percentage of Solids by Volume | $N_{psv}$ | % |
| Flow rate | $V_{fr}$ | gpm |
| Open Hole Days | $N_{day}$ | — |
| Angle at the casing shoe | $\theta_{shoe}$ | degrees |

Default variables are defined to be those quantities that are measured when possible or, in the absence of actual measurement, are calculated using basic engineering principles or obtained through statistical analysis. The default variables used in the presently preferred embodiments are listed in Table 2 along with their identifying symbols and units of measure.

TABLE 2

DEFAULT VARIABLES

| PARAMETERS | SYMBOL | UNITS |
|---|---|---|
| Vertical Depth of the Well | $D_{ver}$ | feet |
| Vertical Depth of the Casing Shoe | $D_{cvert}$ | feet |

TABLE 2-continued

| DEFAULT VARIABLES | | |
|---|---|---|
| PARAMETERS | SYMBOL | UNITS |
| Pore Pressure Gradient at the Well Bottom | $F_{ppb}$ | ppg |
| Overburden Stress Gradient at the Well Bottom | $F_{osb}$ | ppg |
| X-Direction Horizontal Stress Gradient at the Well Bottom | $F_{xb}$ | ppg |
| Y-Direction Horizontal Stress Gradient at the Well Bottom | $F_{yb}$ | ppg |
| Pore Pressure Gradient at the Casing Shoe | $F_{ppc}$ | ppg |
| Overburden Stress Gradient at the Casing Shoe | $F_{osc}$ | ppg |
| X-direction Horizontal Stress Gradient at the Casing Shoe | $F_{xc}$ | ppg |
| Y-direction Horizontal Stress Gradient at the Casing Shoe | $F_{yc}$ | ppg |
| Normal Drag | $F_{nd}$ | Kilo-pounds |
| Well-x-direction Angle | $\theta_{wxd}$ | degrees |
| Open-hole Shale Percentage | $N_{ohsp}$ | % |
| Kick-off Point | $D_{kop}$ | feet |

The model uses measured values whenever they are available and otherwise estimates or calculates values using the equations of Table 3.

TABLE 3

DEFAULT VARIABLE EQUATIONS $$D_{ver}(x) = D_{kop} + \sum_{i=1}^{x} (D_i - D_{i-1}) \cos(\theta_i),\ D > D_{kop} \quad (1)$$

$$= D,\ D \leqq D_{kop}$$

$$D_{cvert}(y) = D_{kop} + \sum_{i=1}^{x} (D_i - D_{i-1}) \cos(\theta_i),\ D_{cas} > D_{kop} \quad (2)$$

$$= D_{cas},\ D_{cas} \leqq D_{kop}$$

$$F_{ppb} = W_{mud}(D_{cvert}) - 0.5 \quad (3)$$

$$F_{ppc} = W_{mud}(D_{cvert}) - 0.5 \quad (4)$$

$$W_{mud}(D_{cvert}) = 4.774 \times 10^{-9} D_{cvert}^2 + 3.629 \times 10^{-4} D_{cvert} + 9.55 \quad (5)$$

$$F_{osb} = 1.36 \times 10^{-4} D_{ver} + 16.8 \quad (6)$$

$$F_{osc} = 1.36 \times 10^{-4} D_{cvert} + 16.8 \quad (7)$$

$$F_{xb} = 0.98\,(F_{ppb} + 1.34\,(F_{osb} - F_{ppb}) - 0.0718\,(F_{osb} - F_{ppb})^2) \quad (8)$$

$$F_{yb} = 1.1\,F_{xb} \quad (9)$$

$$F_{xc} = 0.98\,(F_{ppc} + 1.34\,(F_{osc} - F_{ppc}) - 0.0718\,(F_{osc} - F_{ppc})^2) \quad (10)$$

$$F_{yc} = 1.1\,F_{xc} \quad (11)$$

$$F_{nd} = 1.56 \times 10^{-4} F_{norm}^2 + 0.148 F_{norm} + 1.189 \times 10^{-3} D - 4.436 \quad (12)$$

FIG. 1 illustrates the definition of selected variables from Table 1 and Table 2. FIG. 1 depicts well bore 10 in which casing 15 has been set and through which drill string 16 with bottom hole assembly 18 is run. Well bore 10 has been drilled beneath ground surface 20 in a preselected geological region. Some drilling equipment and tools, such as pumps, cement, and drilling mud, are not illustrated for the sake of clarity. The measured depth of the well (D) is determined from the length of drill string 16 needed to place the drill bit of bottom hole assembly 18 at end 12 of well bore 10 and is therefore defined to be distance from ground surface 20 to end 12 as measured through well bore 10. The measured depth of casing at the casing shoe ($D_{cas}$) is similarly measured between casing shoe 14 and ground surface 20. The vertical depth of the well bore ($D_{ver}$) is defined to be the distance directly between end 12 and ground surface 20, rather than through well bore 10, and may be calculated according to Eq. (1). The vertical depth of the casing shoe ($D_{cvert}$) is likewise defined to be the distance directly between casing shoe 14 and ground surface 20 rather than through well bore 10 and can be calculated with Eq. (2). Maximum well angle ($\theta_{mwa}$) is defined as the maximum angular deviation of well bore 10 from the vertical which occurs in FIG. 1 at approximately point 27. Likewise, the angle at the casing shoe ($\theta_{shoe}$) is the angular deviation from the vertical at point 29 and the current drilling angle ($\theta$) is the angular deviation from the vertical at end 12 of bore 10. The inner diameter of the hole ($D_{hid}$), the drill collar outer diameter ($D_{dco}$), and the bottom hole assembly length ($L_{hba}$) are self-explanatory.

The kick-off point ($D_{kop}$) is defined to be the point at which the well bore begins to deviate from the vertical and corresponds to the distance between point 25 in well bore 10 and ground surface 20 of FIG. 1. In the preferred embodiment, $D_{kop}$ is estimated to be the average depth at which the kick-off point is found in Exxon's Gulf of Mexico wells whenever a measured value is not available and must be adjusted to the average value of whatever geological region the model is being applied to. Similarly, the open-hole shale percentage ($N_{ohsp}$) default value is estimated to be the average value of Exxon's Gulf of Mexico wells when no measured value is available and must be adapted according to the geological region whose probabilities are being modeled. The well x-direction angle ($\theta_{wxd}$) default value is simply set at 45°. The remaining default variables in Table 2 are calculated from either the field drilling variables or other default variables using Eqs. (1–12) in Table 3 when measured values are unavailable or are obtained through statistical analysis, such as regressions, of field drilling variables and default variables.

Vertical depth ($D_{ver}$) in Eq. (1) is calculated for the current day of drilling, day x, and summation extends to the depths of all drilling days between the day on which the kickoff point is reached and the current day wherein $D_0$ is defined to be $D_{kop}$. The vertical depth of the casing shoe ($D_{cvert}$) is calculated with Eq. (2) wherein the summation extends to all days between the day on which the kickoff point was reached and the day the casing was set. If the well has not yet reached the kickoff point, $D_{ver}$ is set to the measured well depth and $D_{cvert}$ is set to the measured depth of the casing. $F_{ppb}$ and $F_{ppc}$ are separate variables calculated with the same equation. This is because, although the two variables are highly dependent on the same field variable, where actual measurements are available those measurements may include one and not the other or differ for each of the variables. Where either Eq. (3) or Eq. (4) yields a value <8.9 ppg, $F_{ppb}$ or $F_{ppc}$ is simply set at 8.9 ppg and where they yield a value >16.5 ppg they are set to 16.5 ppg. The quantity $F_{norm}$ in Eq. (12) is defined to be the normal contact force, which is an engineering parameter and is discussed in fuller detail below.

It is to be noted that while all field drilling variables are measured from the historical wells, default variables may be measured but are more often derived from a number of sources. For instance, $D_{ver}$ is calculated as a function of field drilling variables D, $D_{kop}$, and θ while $F_{nd}$ is calculated as a function of the engineering parameter $F_{norm}$ and D, and $F_{ppb}$ and $F_{ppc}$ are calculated as functions of the default variable $D_{cvert}$. It can therefore be seen that where default variables must be calculated they can be calculated from (a) measured field drilling variables, (b) measured default variables, (c) default variables previously calculated from measured values (regardless of whether the measured values are field drilling variables or default variables), (d) default variables obtained through statistical analysis, and (e) other values obtained through statistical analysis.

The model provides a quantification of tile probability of sticking within a given time frame constituting a selected number of days. The time frame is important primarily because its selection is a necessary condition for quantifying the probability of sticking and also because it provides drilling engineers an opportunity to evaluate whether corrective action is needed and, if so, to ascertain what that corrective action may be before the drill string becomes stuck. The time frame dictates which observations are used from the historical wells wherein the drill string became stuck.

For instance, the preferred embodiment contemplates modeling and determination of the probability of sticking within three days. This is accomplished by incorporating field variables from observations taken in historical wells that become stuck for the day of sticking and the three days previous. By extrapolation, the probability of sticking within x days dictates use of observations taken on the day of sticking and the x days preceding it. The model can be used as a simple surveillance tool to monitor the change in sticking probability like the '998 patent in an alternative embodiment simply by using observations from the day of sticking only and none from the preceding days. There are three basic categories of time frames, those being (1) the day of sticking, (2) the day of sticking and a number of days immediately prior to the day of sticking, and (3) a number of days immediately prior to the day of sticking but not the day of sticking. A long time frame is desirable to provide drilling engineers with an opportunity to assess the need for corrective action and implement it if necessary. An excessively long time frame will nonetheless decrease the accuracy of the model.

Once the field parameters are identified, the engineering parameters are derived from them. These engineering parameters must be directly related to one or more physical mechanisms that can cause stuck pipe and it must be clearly evident how a change in the parameters will affect the probability of a drill string becoming stuck. For example, a high force on the drill collars is a substantial factor contributing to differential sticking with the chance of the drill string becoming stuck increasing as the force on the drill collars increases, assuming that all other factors remain equal. Force on the drill collars is therefore an acceptable engineering parameter.

The engineering parameters must also be substantially independent of each other and contribute materially to discriminating between differentially stuck, mechanically stuck, and nonstuck observations. Substantial independence is defined in the preferred embodiment as having a correlation coefficient of less than 0.65 relative to any other engineering parameter. Material contribution is defined in the preferred embodiment to be an F-value greater than 1.0 in one-way analysis of variance and 2.0 in multivariate test statistics. Values other than 0.65, 1.0, and 2.0 may be used if deemed desirable. Further, materiality of contribution in one-way analysis of variance can be used regardless of the measure in multivariate test statistics, and vice versa, if desired. The engineering parameters contemplated by the preferred embodiment are listed in Table 4 along with their identifying symbols and units of measure.

TABLE 4

ENGINEERING PARAMETERS

| PARAMETER | SYMBOL | UNITS |
|---|---|---|
| Corrected Maximum Differential Stress | $F_{new}$ | psi |
| Open Hole Days | $N_{day}$ | — |
| Force on Drill Collars | $F_{cor}$ | pounds |
| Number of Stabilizers | $N_{stab}$ | — |
| Normal Contact Force | $F_{norm}$ | Kilo-pounds |
| Excess Drag | $F_{xd}$ | — |
| Differential Pressure Force | $F_{dp}$ | pounds |
| Effective Velocity | $V_{eff}$ | $fps(in)^{1/2}$ |

The corrected maximum differential stress ($F_{new}$) is defined as the product between the maximum differential stress ($F_{max}$) and an experimentally determined function of the open hole shale percentage ($N_{ohsp}$):

$$F_{new}=F_{max}f(N_{ohsp}) \tag{13}$$

The maximum differential stress ($F_{max}$) is the maximum of the differential stress at the bottom of the well ($F_{btm}$) and the differential stress at the casing shoe ($F_{cas}$) where $F_{btm}=F_{ssb}-F_{stb}$ $F_{cas}=F_{ssc}-F_{stc}$ $F_{ssb}$=maximum shear stress at the well bottom $F_{stb}$=rock strength at the well bottom $F_{ssc}$=maximum shear stress at the casing shoe $F_{stc}$=rock strength at the casing shoe The derivation and calculation of $F_{ssb}$, $F_{stb}$, $F_{ssc}$, $F_{stc}$ are well known to those skilled in the art. $F_{ssb}$ and $F_{ssc}$ are computed using von Mises's criteria. Calculation of $F_{stb}$ and $F_{stc}$ depends on many factors such as mechanical properties of the rock, stress conditions, and exposure to drilling fluid as is well known, but will vary from producer to producer in accord with each producer's proprietary knowledge and information.

The engineering parameters of the preferred embodiment include open hole days ($N_{day}$) and the number of stabilizers ($N_{stab}$), both of which are also field variables. Open-hole days is defined to be the number of drilling days since drilling was resumed after the last casing string was set. It has been promoted to an engineering parameter because it possesses characteristics of engineering relevance and satisfies the statistical criteria discussed above. The number of stabilizers has also been promoted to engineering parameter status because it is directly related to a physical mechanism and its effect on probability of sticking is clearly demonstrable, i.e., drag along the bottom hole assembly is related to the number of stabilizers and therefore so is the probability of sticking. Further, the number of stabilizers is substantially independent of the other engineering parameters and materially contributes to statistically discriminating between the different classes of observations.

The force on the drill collars ($F_{cor}$) and the normal contact force between the drill string and the well bore ($F_{norm}$) also satisfy the requirements for engineering parameters. $F_{cor}$ is mathematically defined as:

$$F_{cor}=W_c L_{bha} \sin\theta(1.0-R) \tag{14}$$

where all quantities are defined previously in this specification except as follows:

$W_c$=weight of the drill collars in mud per unit length $$R=f(H)\, G^{1/4}\left[\frac{D_{dco}^2+7.84}{56.84}\right]^{1/2} \tag{15}$$

f(H)=function of distance between stabilizers= $2.469-0.0375L_s+2.28\times10^{-4}Ls^2-4.8\times10^{-7}L_s^3$ $L_s$=distance between stabilizers G=annular gap between the borehole and the drill collars The normal contact force is mathematically defined as:

$$F_{norm}=2\, W_{pu} \sin\left(\frac{\theta_{mwa}}{2}\right) \tag{16}$$

where all quantities are previously defined.

Excess drag ($F_{xd}$) is defined to be the difference between the actual drag and the normal drag ($F_{nd}$). The normal drag is determined as in Eq. (12) whereas the actual drag is defined to be one half the difference of the pick up weight ($W_{pu}$) and the slack off weight ($W_{so}$), both of which are field variables and therefore are measured values. Excess drag can therefore be represented as $$F_{xd}=\frac{1}{2}\,(W_{pu}-W_{so})-F_{nd} \tag{17}$$

The differential pressure force ($F_{dp}$) is defined to be the product of the differential pressure ($P_{res}$), the length of the bottom hole assembly ($L_{bha}$), and the calculated width ($D_w$) of the contact region between the drill collars and the mud cake:

$$F_{dp}=P_{res}L_{bha}D_w \tag{18}$$

where $L_{bha}$ is previously defined and:

$$P_{res} = \begin{cases} 0.052D_{ver}(W_{mud}-F_{ppb}), & W_{mud}>F_{ppb}; \\ 0, & W_{mud}<=F_{ppb} \end{cases} \tag{19}$$

and $$D_w=\frac{\sqrt{[D_{hid}K-K^2][2\,D_{dco}(0.5(D_{hid}-D_{dco}))-D_{hid}K+K^2]}}{0.5(D_{hid}-D_{dco})} \tag{20}$$

$$K=\text{filter cake thickness}=\frac{0.010996\, V_{api}N_{psv}}{N_{psv}-N_{psc}} \tag{21}$$

$N_{psc}$ = percent suspended solids in cake

If K>G–0.1 (G=annular gap, as above) then K is set equal to G–0.1.

The effective velocity is given by the formula $$V_{eff}=V_0\left[0.25\left(\frac{(2.65)(8.34)}{W_{mud}}-1\right)\right]^{-1/2} \tag{22}$$

where $$V_0=\frac{V_{fp}/(1+((10^{-9}\theta_{moh}^6)/(1+2\times10^{-9}\theta_{moh}^6))}{1/2(D_{hid}+5)} \tag{23}$$

Once the engineering parameters have been derived they are subjected to canonical discriminant analysis, which is a common technique of multivariate statistical analysis that was also used in the '998 patent. Very simply, the analysis determines two linear combinations of the engineering parameters called canonical functions. For example:

$$CAN_x=a_0+a_1E_1+a_2E_2+a_3E_3+a_4E_4+a_5E_5+a_6E_6+a_7e_7+a_8E_8 \tag{24}$$

$$CAN_y=b_0+b_1E_1+b_2E_2+b_3E_3+b_4E_4+b_5E_5+b_6E_6+b_7E_7+b_8E_8 \tag{25}$$

where $E_1$–$E_8$ are previously derived engineering parameters.

These linear combinations must provide high multivariate discrimination among mechanically stuck, differentially stuck, and non-stuck observations, and ideally provide the highest possible discrimination. Coefficients $a_0$–$a_8$ and $b_0$–$b_8$ are called canonical coefficients. The analysis yields m–1 canonical functions for m number of observation classifications and can be applied to as many observation classifications as there are sticking mechanisms plus one. The number of canonical functions, however, cannot exceed the number of engineering parameters.

The preferred embodiment contemplates three classification groups: mechanically stuck, differentially stuck, and non-stuck. It will therefore yield two canonical functions. Canonical discriminant analysis is well known in the art and is treated in greater detail in "SAS User's Guide: Statistics" Chapter 13, pps. 155–169 (Version 5 Ed. ) available from SAS Institute, Inc., Box 8000, Cary, N.C. 27511-*8000*. This reference and the accompanying software are widely known in the petroleum production industry, hence among those ordinarily skilled in the art. It is to be noted that the person of ordinary skill in the art to which this pertains is a person who would design or implement this type of method as opposed to the person who simply collects or enters the data used in the analysis.

Figure 2:
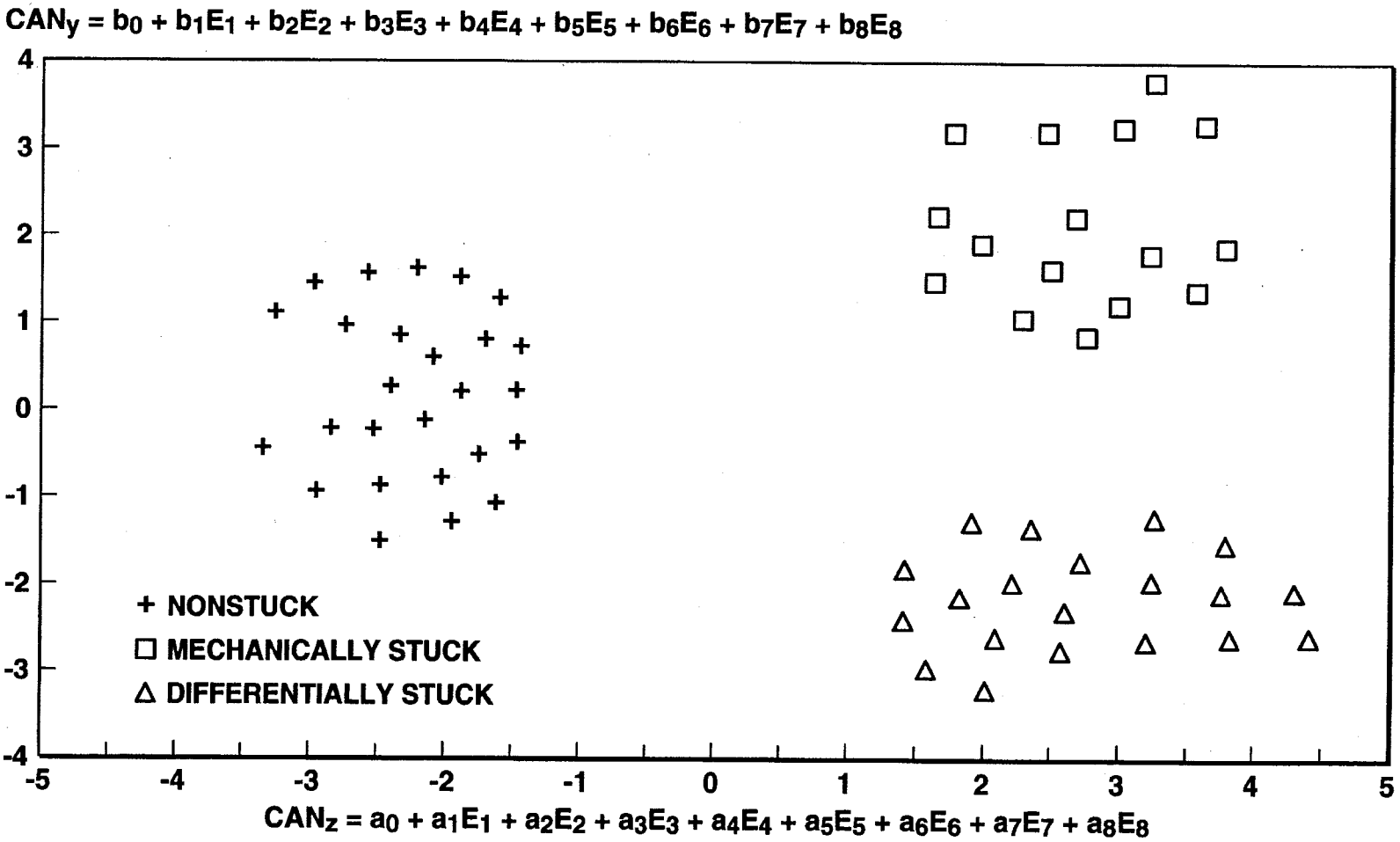
FIG. 2 depicts a hypothetical canonical space into which the canonical representations of historical observations have been mapped.

The canonical coefficients, such as $a_0$–$a_8$ and $b_0$–$b_8$ in Eqs. (25) and (26), are used to construct an n-dimensional canonical space, where n=m–1 and 1<n≦the number of engineering parameters. It is therefore conceivable that an eight dimensional space could be constructed with canonical discriminant analysis if nine observation classifications were used. The preferred embodiment, however, classifies observations into only three groups where the string remained unstuck or became stuck due to mechanical or differential sticking dictating a two-dimensional plane. A canonical point representation of each observation taken in the historical wells is developed using their corresponding engineering parameter values, previously derived coefficients $a_0$–$a_8$ and $b_0$–$b_8$, and Eqs. (24) and (25). The representations are then mapped into the canonical space to indicate areas of high likelihood of mechanical sticking, differential sticking, and remaining unstuck. FIG. 2 depicts such a map produced with hypothetical data. These representations and the canonical space can be depicted visually as shown in FIG. 2 but do not necessarily require it. Indeed, a three dimensional canonical space would be difficult to depict and still higher order dimensions would be beyond human ability to visually depict.

The final step in modeling the probability of sticking is to determine the posterior probability of sticking that corresponds to each point in the canonical space. This final step in the preferred embodiment is comprised of three parts: first, probability density functions are constructed from all of the observations taken in the historical wells; second, the prior probabilities of sticking are determined (i.e., if two in ten wells become mechanically stuck and one in ten becomes differentially stuck, then the prior probabilities for mechanical sticking, differential sticking and non-sticking are 0.2, 0.1, and 0.7, respectively); finally, the posterior probabilities are calculated for each point in the canonical space from the probability density functions and prior probabilities but other ways of calculating them may be equally effective. The preferred embodiment contemplates the use of Bayes Theorem, a well known mathematical theorem, for calculating posterior probabilities. The posterior probabilities are then mapped into the canonical space to provide a quantification of the risk of a drill string becoming stuck under the conditions corresponding to a particular canonical point in the canonical space. This mapping can be visualized in a canonical plane by plotting isoprobability curves.

The model is applied to a drill string in a well being drilled by first ascertaining the values of the previously derived engineering parameters from the values of the field parameters taken from observations in the well being drilled. The current well's engineering parameters are multiplied by their corresponding coefficients $a_0$–$a_8$ and $b_0$–$b_8$ in Eqs. (24) and (25) obtained in the canonical discriminant analysis described above and used in constructing the canonical space. The canonical functions thus calculated form a canonical point representation of drilling in the well bore and are mapped into the canonical space. The posterior probability associated with that representation is the probability of sticking for the drill string within the given time period.

Figure 3:
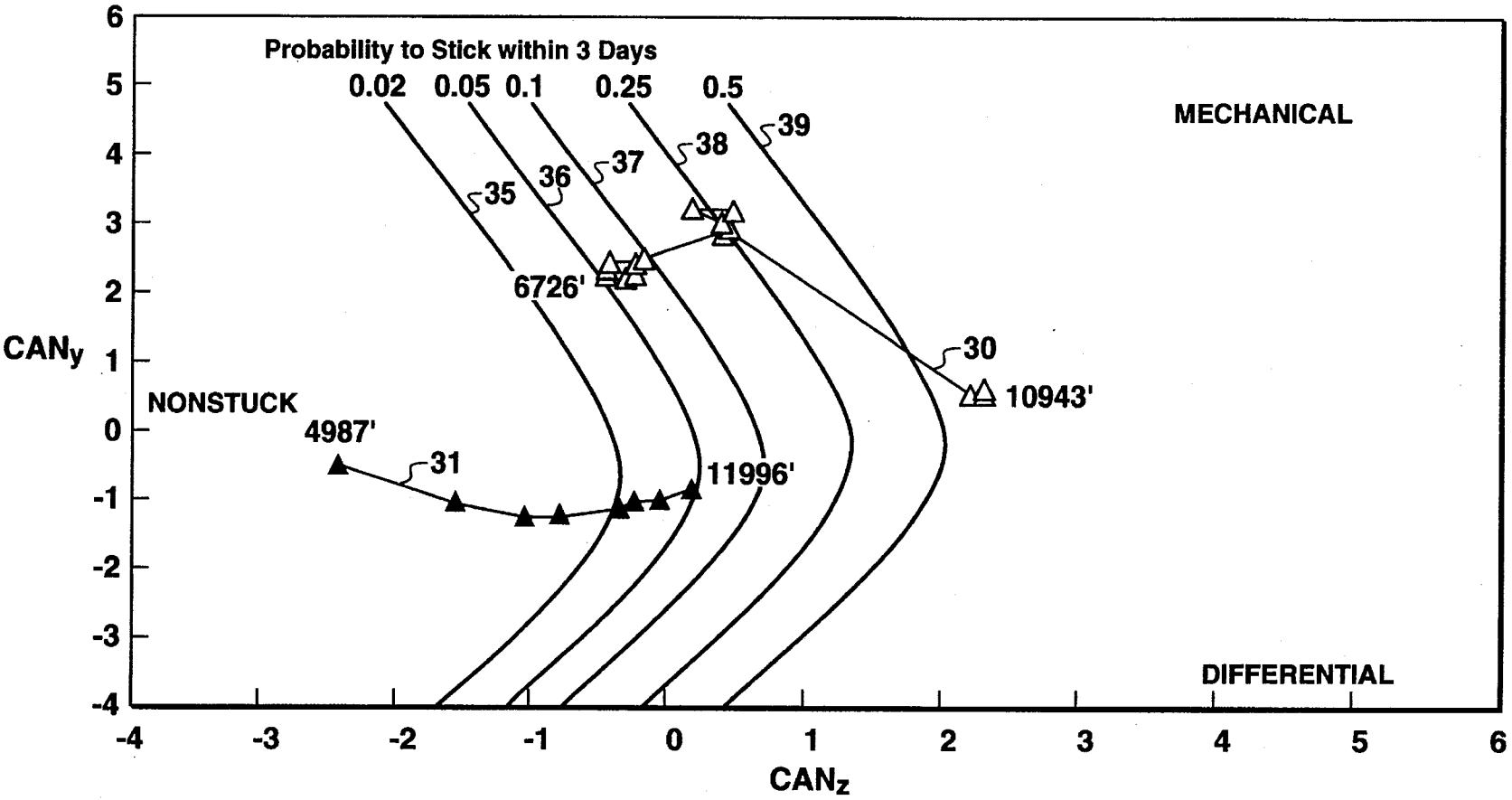
FIG. 3 illustrates analysis of the development of probability of sticking in two wells using isoprobability curves in the canonical space.

The preferred embodiment contemplates further analysis once the probability of sticking in the well being drilled has been determined. A first type of subsequent analysis is illustrated in FIG. 3. FIG. 3 illustrates probability of sticking history 30 for a first well and probability of sticking history 31 for a second well as plotted on the map of FIG. 2. The indications of result for historical observation found in FIG. 2 are omitted from FIG. 3 for clarity. Probability history 30 actually maps over the period where well measured depth ranges from 6,726'–10,943' while probability history 31 maps the range from 4,987'–11,996'. Iso-probability curves 35–39 are constructed by connecting the points in the canonical space having the same posterior probability of sticking, i.e., all points on iso-probability curve 35 are mapped with a 0.02 probability and all points having a probability of 0.02 fall on curve 35, the sticking to occur within a three day time frame. Curves 35–39 can be constructed for any desired probability and in any number, five curves at the indicated probabilities being shown only for illustrative purposes.

Figure 4:
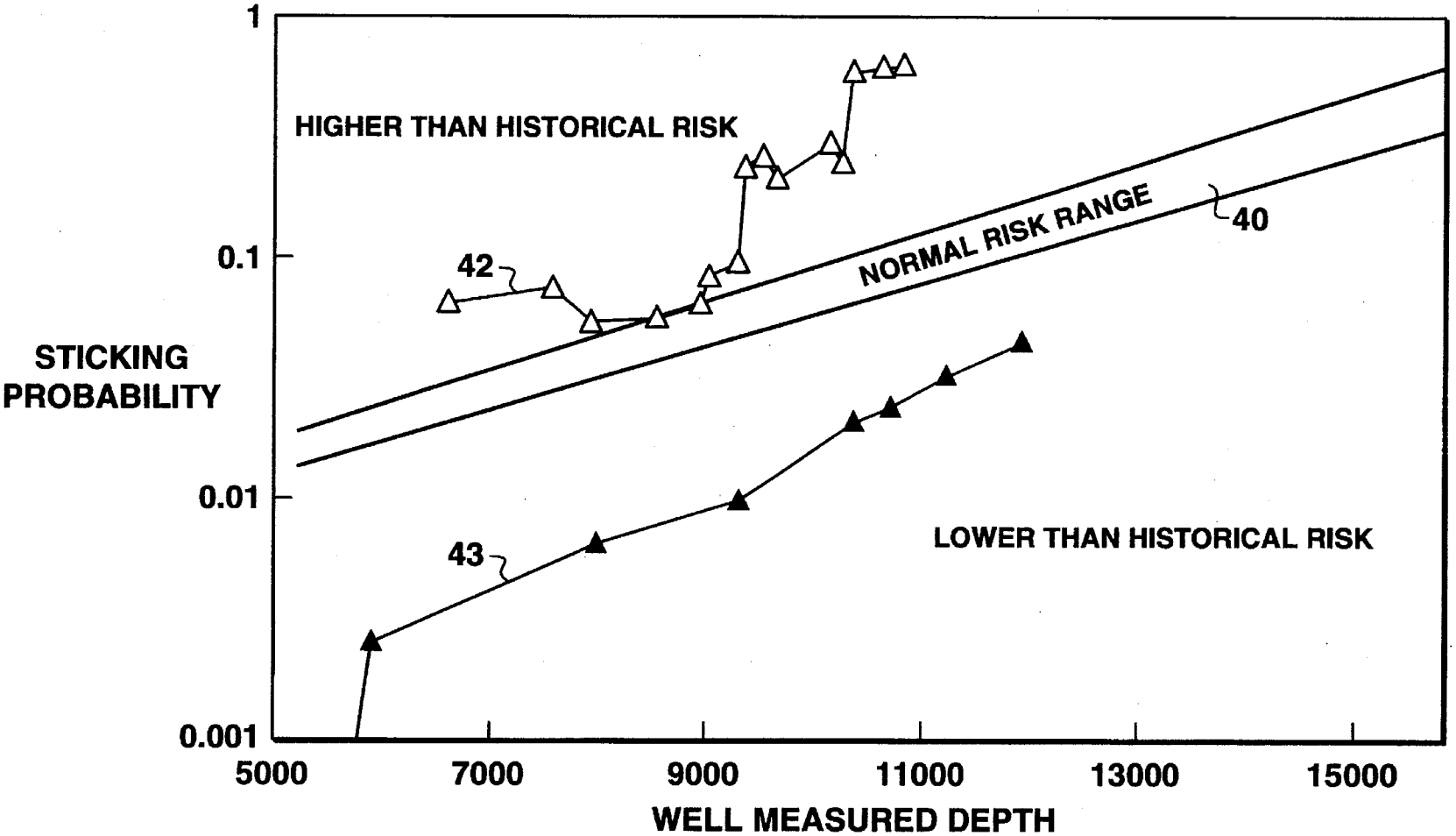
FIG. 4 illustrates analysis of probability of sticking with normal, or expected risks, as a function of a selected parameter.

Another form of subsequent analysis is depicted in FIG. 4. In FIG. 4 the probability of sticking is plotted as a function of a selected parameter in accordance with observations taken in the historical wells. Measured well depth has been selected for purposes of illustration only since it is a leading field parameter in affecting the probability of sticking. From these historical probabilities normal risk range 40 is determined, range 40 being defined by statistical considerations well known to those in the art. Probability histories 42–43 of wells being drilled are plotted as a function of well measured depth to determine whether the probability of sticking is within normal risk range 40 or represents a risk that is lower or higher than is to be expected. As can be seen from FIG. 4, probability history 43 is well below the expected risk while probability history 42 has consistently been higher than normal. A drilling engineer viewing FIG. 4 may well determine that corrective action is needed to improve drilling conditions in the well of probability history 42. The specific corrective action to take if an overly high risk is encountered can be determined by simple inspection of the values of the engineering parameters since, by definition of engineering parameter, it is evident how a change in a parameter will affect the probability of a drill string becoming stuck.

Still further alternative embodiments are contemplated. One such alternative embodiment omits the step of calculating posterior probabilities. The method of modeling is otherwise the same and when the model is applied the feature of the preferred embodiment wherein it provides a quantification of the risk of sticking is eliminated. It is nevertheless superior to the prior art because use of the engineering parameters will produce a more accurate map in the canonical space due to their statistical independence and high statistical significance. Further, the engineering parameters also yield better determinations of what corrective action to take because of their engineering significance, independence, and material contribution to sticking risk.

A second alternative embodiment performs a canonical discriminant analysis on field parameters rather than on the engineering parameters and uses the resulting canonical coefficients to construct the canonical space before mapping the posterior probabilities. This alternative embodiment eliminates the above-mentioned advantages obtained in constructing the canonical space by using engineering parameters. It nevertheless yields a quantification of the probability of sticking under given conditions within the specified time period that can be analyzed by drilling engineers to determine whether corrective action is needed. In this embodiment the number of canonical functions, which is equal to the number of sticking mechanisms considered in defining the observation classifications, cannot exceed the number of field parameters.

Both alternative embodiments are therefore less desirable than the primary preferred embodiment but are nonetheless significant improvements over the prior art. While particular embodiments of the invention have been shown in the preferred embodiment and its alternatives, the invention is not limited thereto. Other modifications may still be made which may become apparent to those skilled in the art.

What is claimed is:

1. A method for controlling drilling of a current well into a geological region to avoid sticking of a drill string in the well, the method comprising the steps of:

(a) determining a plurality of field parameters and values thereof from at least two historical wells in the geological region for drilling a borehole wherein drill strings became stuck and from at least two historical wells in the geological region wherein drill strings remained unstuck;

(b) deriving with aid of a computer from the field parameters a plurality of engineering parameters and values for the engineering parameters, the engineering parameters being substantially independent of one another and being statistically significant in discriminating physical mechanisms associated respectively with the drill strings becoming stuck and remaining unstuck;

(c) determining field parameter values for the current well using the same field parameters of step (a);

(d) deriving values of the engineering parameters for the current well;

(e) comparing the engineering parameter values for the current well with the engineering parameter values for the historical wells to determine the probability of the drill string becoming stuck in the current well; and (f) if such comparison indicates an unacceptably high probability of the drill string becoming stuck in the current well, modifying at least one field parameter value of the current well to decrease such probability to an acceptable level.

2. The method of claim 1 wherein the step of comparing the engineering parameter values for the current well with the engineering parameter values for the historical wells comprises:

determining through canonical discriminant analysis of the engineering parameter values of historical wells at least one set of canonical coefficients that when used to linearly combine said engineering parameters provide high multivariate discrimination between groups of nonstuck and stuck observations;

constructing a canonical space from the canonical coefficients and from the engineering parameter values, the canonical space having n dimensions wherein n is an integer greater than or equal to one and less than or equal to the number of the engineering parameters;

obtaining a canonical point representation in the canonical space of drilling in the current well; and ascertaining the current probability of sticking from said canonical point representation of drilling in the current well in relation to the canonical representations of the stuck and nonstuck observations in the historical wells.

3. The method of claim 1 wherein the stuck observations in historical wells are representative of at least one of mechanical sticking and differential sticking.

4. The method of claim 1 wherein the step of comparing the engineering parameter values for the current well with the engineering parameter values for the historical wells comprises determining the historical probability of sticking and the current probability of sticking by plotting historical probability of sticking and the current probability of sticking as a function of selected field parameters for a visual determination of whether or not a correction is necessary to reduce said probability of sticking in the current well.

5. The method of claim 1 wherein the current probability of sticking is a posterior probability of sticking determined from the stuck and nonstuck observations in the historical wells.

6. The method of claim 1 wherein the step of comparing the engineering parameter values for the current well with the engineering parameter values for the historical wells comprises (a) determining posterior probabilities of sticking from the stuck and the nonstuck observations taken in the historical wells;

(b) mapping the posterior probabilities to respective canonical point representations in the canonical space;

(c) ascertaining the probability of sticking from the posterior probability mapped to the canonical point representation of drilling in the current well; and (d) determining which of said field parameters are contributing the most to the current probability of sticking when said probability of sticking is higher than the acceptable range of historical probability of sticking.

* * * * *